US010400734B2

(12) United States Patent
Bauer et al.

(10) Patent No.: US 10,400,734 B2
(45) Date of Patent: Sep. 3, 2019

(54) ELECTRIC MACHINE HAVING A HOUSING IN THE FORM OF A DRIVE BEARING AND HAVING AN INTERNAL GEAR MOUNTED THEREIN

(71) Applicant: Robert Bosch GmbH, Stuttgart (DE)

(72) Inventors: Bernhard Bauer, Althuette (DE); Frank Reschnar, Ilsfeld (DE); Stefan Erlenmaier, Sersheim (DE); Mike Foell, Stuttgart (DE); Jean-Philipp Caro, Ludwigsburg (DE)

(73) Assignee: SEG Automotive Germany GmbH, Stuttgart (DE)

( * ) Notice: Subject to any disclaimer, the term of this patent is extended or adjusted under 35 U.S.C. 154(b) by 43 days.

(21) Appl. No.: 14/840,864

(22) Filed: Aug. 31, 2015

(65) Prior Publication Data

US 2016/0061175 A1 Mar. 3, 2016

(30) Foreign Application Priority Data

Aug. 29, 2014 (DE) ..... 10 2014 217 350

(51) Int. Cl.

| | |
|---|---|
| ***F02N 15/04*** | (2006.01) |
| *F02N 11/00* | (2006.01) |
| *F02N 15/00* | (2006.01) |
| *F02N 15/02* | (2006.01) |
| *F02N 15/06* | (2006.01) |

(52) U.S. Cl.

CPC ..... *F02N 15/046* (2013.01); *F02N 11/00* (2013.01); *F02N 15/006* (2013.01); *F02N 15/022* (2013.01); *F02N 15/063* (2013.01); *F02N 15/067* (2013.01)

(58) Field of Classification Search

CPC ..... F02N 15/046; F02N 11/00; F02N 15/006; F02N 15/022; F02N 15/023; F02N 15/063; F02N 15/067

See application file for complete search history.

(56) References Cited

U.S. PATENT DOCUMENTS 4,561,316 A 12/1985 Bolz et al.
2004/0020315 A1* 2/2004 Vilou ..... F02N 15/067 74/7 A (Continued)

FOREIGN PATENT DOCUMENTS

CN 103775267 A 5/2014
DE 19955061 5/2001

(Continued)

*Primary Examiner* — Zakaria Elahmadi

(74) *Attorney, Agent, or Firm* — Michael Best & Friedrich LLP

(57) ABSTRACT

An electric machine having a housing part which is in the form of a drive bearing (19), having an electric motor (13) as a drive, having a planetary gearing (153) and having a drive element (22), wherein the planetary gearing (153) has at least one planet gear (16) which meshes with an internal gear (73), and a gear carrier (95) which is coupled to the drive element (22) can be driven by means of the planet gear (160), wherein the internal gear (73) has at least one engagement element and the housing part has at least one engagement element, and the at least two engagement elements engage into one another in alternating fashion, characterized in that an intermediate bearing carrier (98) has at least one engagement element and the housing part has at least one engagement element, and the at least two engagement elements engage into one another in alternating fashion.

24 Claims, 6 Drawing Sheets

(56) References Cited

U.S. PATENT DOCUMENTS

| | | | | |
|---|---|---|---|---|
| 2008/0184845 | A1* | 8/2008 | Farrar | F02N 15/046 74/7 E |
| 2011/0094333 | A1* | 4/2011 | Chane-Waye | F16D 3/68 74/7 E |
| 2011/0168116 | A1* | 7/2011 | Billot | F02N 15/046 123/179.1 |
| 2012/0256714 | A1* | 10/2012 | Hartmann | F02N 15/067 335/203 |
| 2013/0074652 | A1* | 3/2013 | Gray | F16D 41/066 74/7 C |
| 2014/0060472 | A1* | 3/2014 | Stoeckl | F02N 15/006 123/179.25 |
| 2014/0260796 | A1* | 9/2014 | Quack | F02N 11/00 74/7 E |
| 2015/0275842 | A1* | 10/2015 | Fujita | F16H 3/725 74/7 E |
| 2016/0061175 | A1* | 3/2016 | Bauer | F02N 15/046 74/6 |

FOREIGN PATENT DOCUMENTS

| | | | | |
|---|---|---|---|---|
| DE | 102012205481 | | 10/2013 | |
| DE | 102013211763 | | 12/2013 | |
| DE | 102013211763 | A1 * | 12/2013 | F02N 15/046 |
| DE | 102013211763 | A1 * | 12/2013 | F02N 15/046 |
| DE | 102012219044 | | 4/2014 | |
| EP | 460824 | | 12/1991 | |
| EP | 863309 | | 9/1998 | |

* cited by examiner

ELECTRIC MACHINE HAVING A HOUSING IN THE FORM OF A DRIVE BEARING AND HAVING AN INTERNAL GEAR MOUNTED THEREIN

BACKGROUND OF THE INVENTION

EP 460 824 A1 and EP 0 863 309 A1 have each disclosed electric machines which serve as starter devices for internal combustion engines. For the purposes of varying the rotational speed and torque characteristic of the electric motor provided there as a drive for driving the drive element, which is preferably in the form of a pinion, a planetary gearing is disclosed. Said planetary gearing has an internal gear which is mounted in a housing part, the latter being in the form of a drive bearing. For this purpose, an engagement element of the internal gear engages into an engagement element of the housing or drive bearing.

Provision is made for vibrations that are generated in the internal gear to be transmitted directly to a component which, with regard to acoustics, has expedient airborne noise radiation and damping characteristics. The housing or drive bearing has these characteristics owing to its geometry, which has a multiplicity of changes in cross section and, in association therewith, a multiplicity of step changes in stiffness, and small radiating surfaces.

Low noise, which is acceptable with regard to acoustic impression, in the motor vehicle is of increasing importance. This applies even in the case of a starting process which is completed after only a few seconds. Start-stop applications and, in future, also the so-called "sailing" mode additionally intensify the requirements and demand corresponding acoustically optimized starters. The so-called "sailing" mode refers, in technical terms, to a method in which, during travel on the road, the internal combustion engine is deactivated when it does not need to transmit any drive power, and is reactivated only when drive power has to be transmitted. Such a driving state exists for example when traveling downhill, such that the transmission of a drive torque or drive power becomes necessary, and thus a starting process is rendered necessary during travel, only after a transition for example to travel on a level road or even an uphill road again.

One of the main noise sources in the starter is the planetary gearing, which is commonly designed as an epicyclic gearing. Owing to alternating tooth meshing and, as a result, fluctuations in rigidity, adjacent components are subjected to excitation and are thus caused to vibrate. Some of said vibrations are radiated by said components as airborne noise, or are transmitted to other surrounding starter components or even engine components, that is to say components of the internal combustion engine, as body-borne noise. In the case of the abovementioned gearing designs, those components whose geometric design exhibits only small changes in cross section and low natural frequencies and large radiating surfaces are subjected to direct excitation. Such components therefore have an unfavorable vibration characteristic with regard to the reduction of noise. In particular, the direct connection of the internal gear to the pole housing, the intermediate bearing and the bearing cover are acoustically unfavorable.

Provision is made for the internal gear, as a noise source, to be fastened in the starter such that as few components as possible are subjected to excitation. The required torque support should in this case be realized on asymmetrical components with good damping characteristics. Excitation of adjacent components should be prevented or reduced.

SUMMARY OF THE INVENTION

It is provided according to the invention that the electric machine is equipped with a housing, which is in the form of a drive bearing, with an electric motor as a drive, with a planetary gearing, and with a drive element. The planetary gearing has at least one planet gear which meshes with an internal gear, wherein a gear carrier which is coupled to the drive element can be driven by means of the at least one planet gear. The internal gear has at least one engagement element and the housing has at least one engagement element. The two engagement elements engage into one another in alternating fashion. Provision is made for an intermediate bearing carrier to have at least one engagement element and for the housing part to have at least one engagement element, and for the two engagement elements to engage into one another in alternating fashion.

If the engagement element of the internal gear is a peg and the engagement element of the drive bearing is a groove, an internal gear is realized which has fewer notches that could lessen the mechanical load capacity of the internal gear. If, in an alternative embodiment, the engagement element of the internal gear is a groove and the engagement element of the drive bearing is a peg, the mass of the internal gear tends to be greater than in the inverse situation. This is because, owing to the grooves on the outer circumference and the action thereof as notches, the ring of the internal gear must, overall, be designed to be somewhat thicker in order to attain the same strength. This has the advantage that, in this way, that is to say owing to the higher mass of the internal gear, there is tendentially reduced excitation of the housing by high frequencies. The internal gear reacts less readily to excitations.

Provision is furthermore made for the engagement element of the intermediate bearing carrier and the engagement element of the internal gear to be mounted axially one behind the other in the housing part. This has the effect that forces which are imparted by the drive element and which are for example introduced into the intermediate bearing carrier are transmitted into the housing without the internal gear being adversely affected by said forces. Here, as forces, axial forces and/or radial forces and/or transverse and/or tangential forces may arise. As viewed from the drive element, said forces are absorbed in the housing already upstream of the internal gear. This may be realized for example by way of a cylindrical fit of the intermediate bearing carrier, which is fitted into a cylindrical receptacle of the housing, and/or by way of engagement elements preferably integrally formed on the intermediate bearing carrier. Forces acting on the internal gear are then transmitted into the housing for the first time axially (axis of rotation of planet gear shaft) downstream of the cylindrical fit of the intermediate bearing carrier. Alternatively or in addition, it is also possible for the forces exerted on the intermediate bearing carrier to be transmitted into the housing at the same circumferential position of the internal gear, which in turn may be realized by way of engagement elements preferably integrally formed on the intermediate bearing carrier. In a further alternative, or in addition, it is also possible for the forces exerted on the intermediate bearing carrier to be transmitted into the housing at the same axial position of the internal gear, which in turn may be realized by way of engagement elements preferably integrally formed on the intermediate bearing carrier.

By means of this form of decoupling, the planet gears rolling in the internal gear are also relieved of corresponding forces and consequently imparted vibrations, and thus the durability of the planetary gearing is increased, and the generation of noise is also reduced. Said decoupling also acts conversely: rotational accelerations imparted by the sun gear and associated torque fluctuations are transmitted into an engagement element of the drive bearing via engagement elements of the internal gear. By means of the intermediate bearing carrier, which is decoupled from the internal gear, between the pinion and the planetary gearing, the intermediate bearing carrier is only indirectly subjected to force fluctuations. In this way, the excitation of the intermediate bearing carrier is considerably reduced, such that in particular, the areal regions of the intermediate bearing carrier are subjected to considerably reduced excitation. In one variant, provision may also be made for the engagement element of the intermediate bearing carrier and the engagement element of the internal gear to be of the same type (peg or groove), and accordingly, for the engagement elements of the internal gear and also of the intermediate bearing carrier, designed for example as pegs, to engage into a common groove of the housing. Provision may alternatively be made for an engagement element of the housing, designed as a peg, to engage both into a groove of the intermediate bearing carrier and into a groove of the internal gear, for engagement into one another in alternating fashion. It is provided in particular that an engagement element of the intermediate bearing carrier and an engagement element of the internal gear are of the same type and engage into the same engagement element of the housing. Provision may alternatively be made for an engagement element of the intermediate bearing carrier to engage into a counterpart or engagement element of the housing, and for an engagement element of the internal gear to engage into a counterpart or engagement element of the housing, wherein the engagement element of the housing for the internal gear is a different engagement element than the engagement element for the intermediate bearing carrier in the housing.

In a further alternative, provision is made for an engagement element of the internal gear and an engagement element of the intermediate bearing carrier to alternate on an inner circumference of the housing, and in this case to be separated by engagement element of the housing part. In the case of this arrangement, the engagement element of the internal gear and the engagement element of the intermediate bearing carrier are nevertheless adjacent.

In a further alternative, provision is made for an engagement element of the internal gear and an engagement element of the intermediate bearing carrier to be arranged at the same circumferential position of the housing.

Provision is preferably made for the internal gear to be arranged between the intermediate bearing carrier between the cranking pinion and the internal gear and a further intermediate bearing carrier, and for the further intermediate bearing carrier to serve for mounting a rotor shaft of the electric motor. The internal gear and the further intermediate bearing carrier are in this case combined to form a unit (in unipartite form or assembled form). Provision is preferably furthermore made for a web on the inner circumference of the housing to be connected in electrically conductive fashion to a component of the electric motor, preferably to a pole tube of the electric motor, preferably by abutment at a face side. This makes it possible to realize an electrical current-conducting path from the component of the electric motor, which is electrically connected for example to the so-called negative brushes, via the housing to a negative terminal, preferably a ground path, to the housing of the internal combustion engine.

The inventions are not restricted to so-called free-ejecting starting devices. The inventions may likewise be used in the case of so-called claw-type starters. In the case of claw-type starters, the drive bearing shield engages over the cranking pinion in the manner of a claw, cf. also DE 199 55 061 A.

BRIEF DESCRIPTION OF THE DRAWINGS

The exemplary embodiments are illustrated below in several figures, in which.

DETAILED DESCRIPTION

Figure 1:
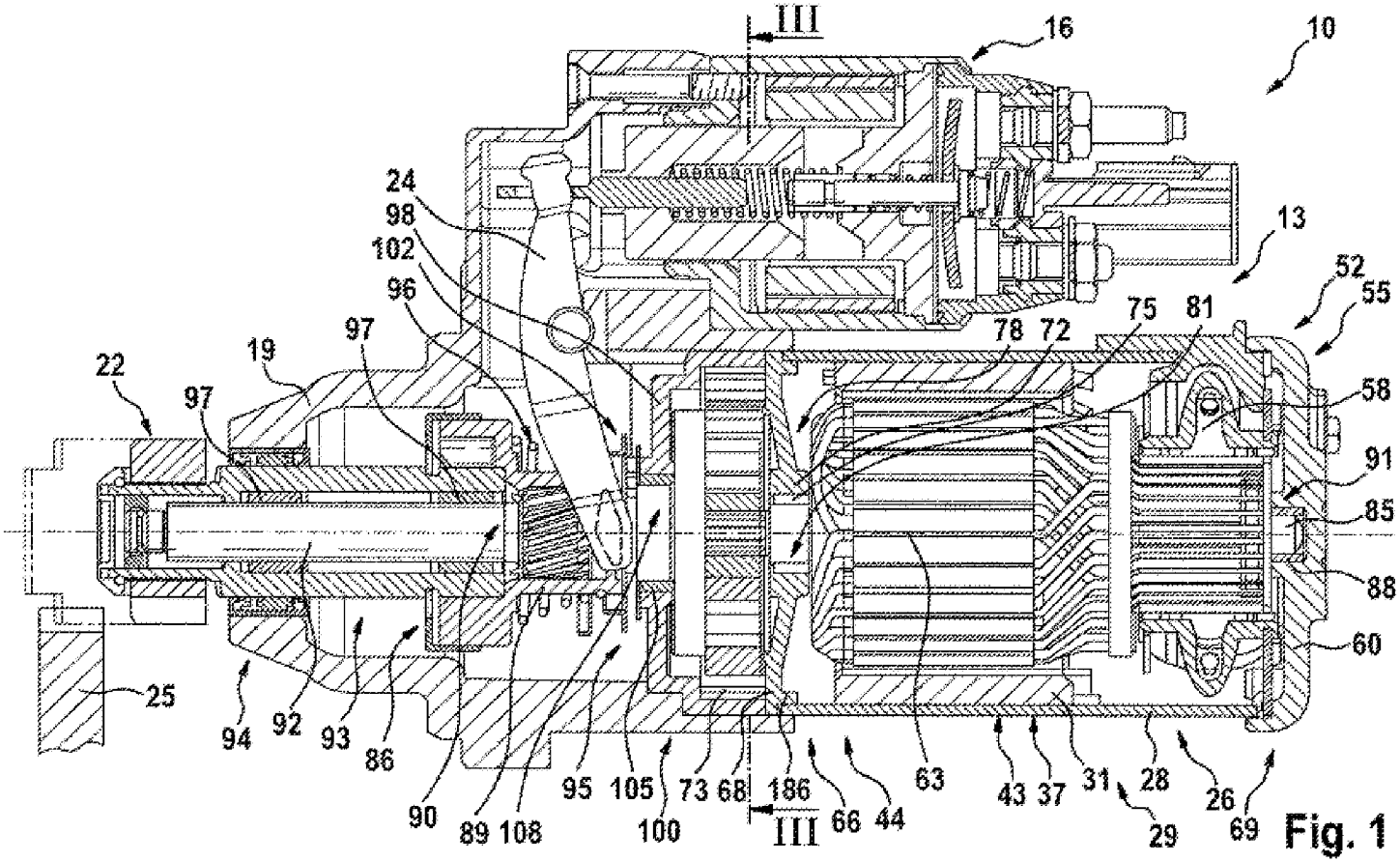
FIG. 1 shows a longitudinal section through a starting device according to the invention.

FIG. 1 shows an electric machine 10, configured as a starting device, in a longitudinal section. Said starting device has for example a starter motor 13 and a pre-engagement actuator 16, which is for example designed as a relay or starter relay. The starter motor 13 and the electrical pre-engagement actuator 16 are fastened to a common drive bearing shield 19. In functional terms, the starter motor 13 serves to drive a drive element 22, which in this case is in the form of a cranking pinion, in rotation when said drive element is engaged into the toothed ring 25 of the internal combustion engine (not illustrated here). The pre-engagement actuator 16 serves for engaging the drive element 22 into the toothed ring 25 by way of a fork lever 24.

The starter motor 13 has a housing 26 with a pole tube 28 which bears poles 31 on its inner circumference. A stator 29 is formed in this way. The poles 31 in turn surround a rotor 37 (armature) which has an armature assembly 43 constructed from lamellae and has an armature winding arranged in grooves. Furthermore, a commutator 52 is attached to that end of a drive shaft 44 which is averted from the drive element 22. The commutator 52, or the commutator lamellae 55 thereof, are supplied with electrical current during operation by way of carbon brushes 58.

In each case one support bearing arrangement 66 and 69 is situated on each side of the rotor 37 in the direction of an axis of rotation 63. The support bearing arrangement 66 is optional. The optional support bearing arrangement 66 between the cranking pinion or the drive element 22 and the armature assembly 46 is in this case constructed as follows: in the pole tube 28 there is inserted an intermediate bearing carrier 68, which in this case is arranged between an internal gear 73 and the armature assembly 43. The intermediate bearing carrier 68 has a central receptacle 72, which carries a substantially cylindrical bearing bushing 75. The receptacle 72 has a rim 78 which prevents a displacement of the bearing bushing 75 in the direction of the drive element 22. The drive shaft 44 is supported in the bearing bushing 75. A special, in particular smooth bearing section 81 serves for this purpose. The support bearing arrangement 66 is suitable for exerting both axial and radial bearing forces on the mounted part.

The other support bearing arrangement 69 is situated on the other side of the rotor 37, that is to say on that side of the rotor which is averted from the drive element 22. The support bearing arrangement 69 is in this case constructed such that a shaft peg 85, which is for example formed in one piece with the drive shaft 44, is mounted in a bushing 88. The bushing 88 is in turn received in a pot-shaped protuberance 91. The protuberance 91 is formed in one piece with the bearing cover 60 which closes off the housing 26.

As viewed from the drive element 22, the following components, stated here in abbreviated form, are situated between the drive element 22 and the internal gear 73: the drive element 22 is seated on a hollow shaft 93 which is mounted in rotatable fashion in a roller bearing 94 in the drive bearing shield 19. The right-hand end of the drive shaft forms an inner ring of a freewheel 86. Said freewheel 86 in turn runs in a driver shank 89 which, on its inner side, has a high-pitch thread internal toothing 90. Said high-pitch thread internal toothing 90 meshes with a high-pitch thread external toothing 96 formed on an outer side of a planet gear shaft 92. The planet gear shaft 92 serves, by way of two plain bearing bushings 97, for the mounting of the abovementioned output shaft, and at its right-hand end, that is to say its end facing toward the planetary or epicyclic gearing, said planet gear shaft ends preferably in a planet carrier 95.

The construction described below describes the arrangement on both sides of the internal gear 73. Between the internal gear 73 and a shoulder 100 in the drive bearing shield 19 there is preferably situated an intermediate bearing carrier 98. Said intermediate bearing carrier 98 has a central bearing receptacle 102, which substantially has an internal cylindrical contour. Said internal cylindrical contour receives a plain bearing 105. The plain bearing 105 supports the planet gear shaft 92 between the planet carrier 95 and the high-pitch thread. Between the bearing receptacle 102 or the plain bearing 105 and the planet carrier 95 there is situated a collar 108 which prevents a displacement of the plain bearing 105 in the direction of the planet carrier 95.

Figure 2:
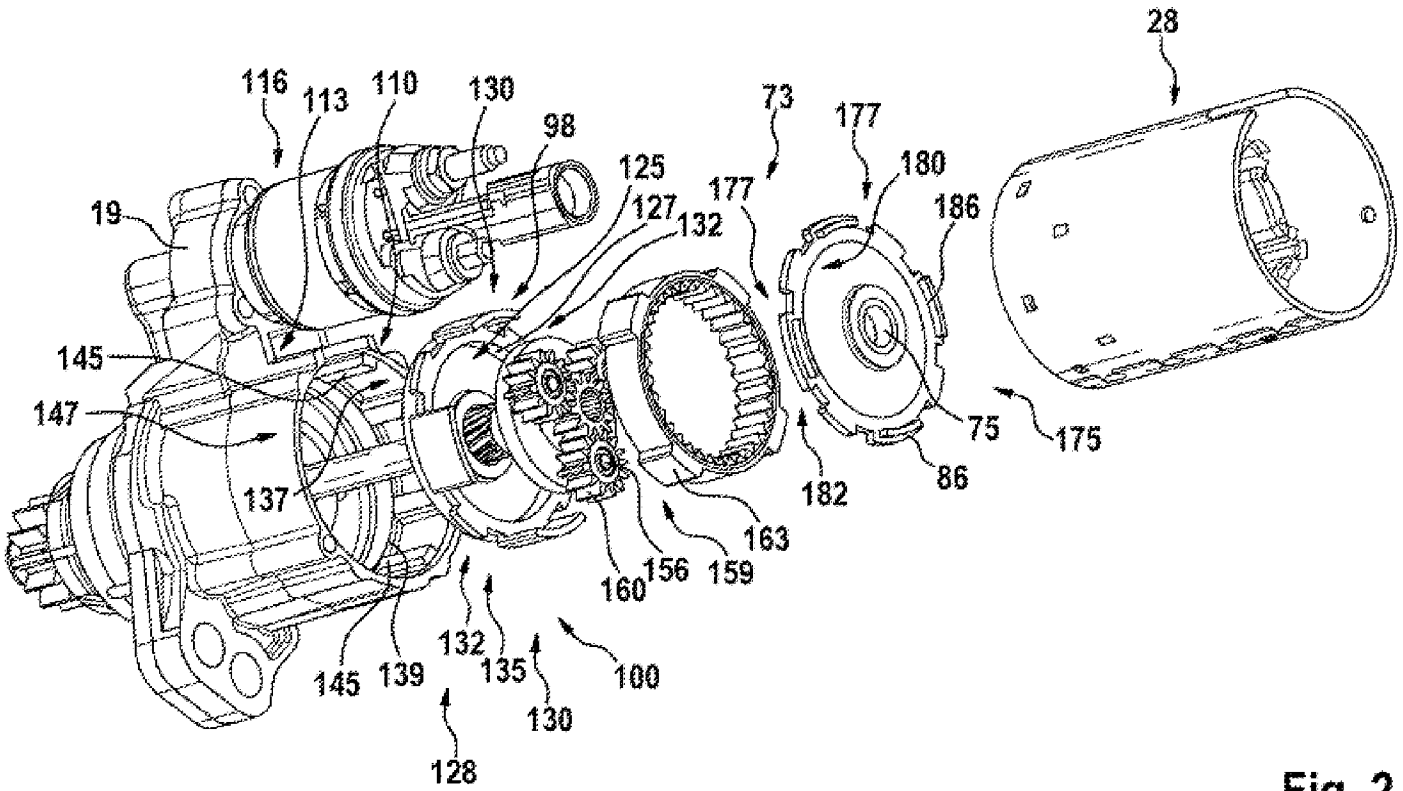
FIG. 2 shows an exploded illustration of a part of the starting device from FIG. 1.

FIG. 2 shows an exploded illustration of some parts of the first exemplary embodiment. The drive bearing shield 19 has a first opening 110 into which the intermediate bearing carrier 98 is inserted. Via an opening 113 for the mounting of a fork lever (not illustrated here but already illustrated in FIG. 1), an opening 116 into which the pre-engagement actuator 16 (engagement relay) engages is connected to the opening 110. A plate (not illustrated) serves as a rotary bearing for bolt stubs (not illustrated here) of the fork lever (not illustrated here) for force absorption. A sealing element (not illustrated) is forced against the plate by the pre-engagement actuator 16.

The intermediate bearing carrier 98 has, overall, a flat pot shape with the central bearing receptacle 102 and the central opening thereof. Situated adjacently radially to the outside, there is a ring-shaped shield region 125 which transitions into an axially short ring-shaped wall 127. A ring-shaped collar 128 extends radially outward from said ring-shaped wall 127. Various regions which are formed integrally on the intermediate bearing carrier 98 extend in a circumferential direction from said ring-shaped collar 128. Accordingly, four shield regions 130 are situated opposite one another at substantially 90° intervals. Between the shield regions 130 there are situated four arc segment-shaped webs 132. Between the total of four webs 132 and the shield regions 130 there is situated in each case one intermediate space 135. Between two shield regions 130 there is thus situated an intermediate space 135 followed by a web 132 and a further intermediate space 135. The shield regions 130 are substantially of cylindrical shell shape.

The webs 132 have a rear wall 137, said rear walls bearing against a face surface 139 of the shoulder 100. The shield regions 130 likewise have a rear wall 142, said rear walls bearing against a face surface 139 of the shoulder 100.

The cylindrical part of the shoulder 100, a fit for the intermediate bearing carrier 98, absorbs transverse forces which act via the drive element 22.

Viewing the opening 110 of the housing which is in the form of a drive bearing shield 19, a structure can be seen on the inner circumference of the housing. Here, said structure comprises, for example, inwardly oriented webs 145 which are interrupted by intermediate spaces 147. In this example, in this case cf. also FIG. 3, it is thus the case that a total of eight webs 145 and eight intermediate spaces 147 alternate with one another on the inner circumference of the opening 110. As a result of the intermediate bearing carrier 98 being pushed in, the four shield regions 130 and also the four webs 132 are pushed into the cylinder ring segment-shaped intermediate spaces 147, in each case into an intermediate space 147 between two webs 145, until the mentioned rear walls 137 and 142, respectively, of the shield regions 130 and webs 132 bear against the face surface 139 between the webs 145.

As the intermediate bearing carrier 98 is pushed in, the shaft 92 is installed with the intermediate bearing carrier 98, that is to say a flange 150 of the planet gear carrier of the planetary gearing 153 protrudes in front of the shield region 125. In this case, three gear pins 156 are inserted into the flange 150. On said gear pins, which are in this case for example planet gear spindles, there is seated in each case one plain bearing bushing 159 or a needle-roller sleeve, which plain bearing bushings or needle-roller sleeves are pressed into a planet gear 160. A sun gear 161 is situated centrally between the in this case three illustrated planet gears 160. The sun gear 161 has, centrally, a toothing which serves as a driver. Said toothing serves ultimately for being plugged onto the rotor shaft. The internal gear 73 is arranged in ring-shaped fashion around the for example three planet gears 160. Said internal gear has, on its outer circumference, preferably four pegs 163 which interrupt the substantially cylindrical outer circumference. The four pegs 163 in this example are spaced apart at 90° intervals.

The internal gear 73 thus pre-installed is in this case arranged such that the pegs 163 are arranged between the shield regions 130, approximately centrally between these. Finally, in this example, the further intermediate bearing carrier 68 is installed. Said intermediate bearing carrier 68 is preferably of shield-like form, that is to say a closed ring-shaped wall 175 is provided between an outer circumference of the intermediate bearing carrier 68 and the bushing 75. Radially outside the ring-shaped wall 175 there is situated an outer contour which is interrupted by intermediate spaces 177. Thus, said outer contour has multiple webs 180 and 182. The webs 180 and 182 alternate on the outer circumference of the intermediate bearing carrier 68. The webs 180 are adapted, in terms of their extent in the circumferential direction, to the webs 132. The webs 182 in turn are adapted to the circumferential extent of the shield regions 130. Offset radially inward slightly from the outer circumference of the intermediate bearing carrier 68, it is preferably the case that four arcuate webs 186 extend in an axial direction, said webs serving, by way of their radially outer side, for centering the pole tube 28 at the inner circumference thereof, cf. also FIG. 1.

Figure 3:
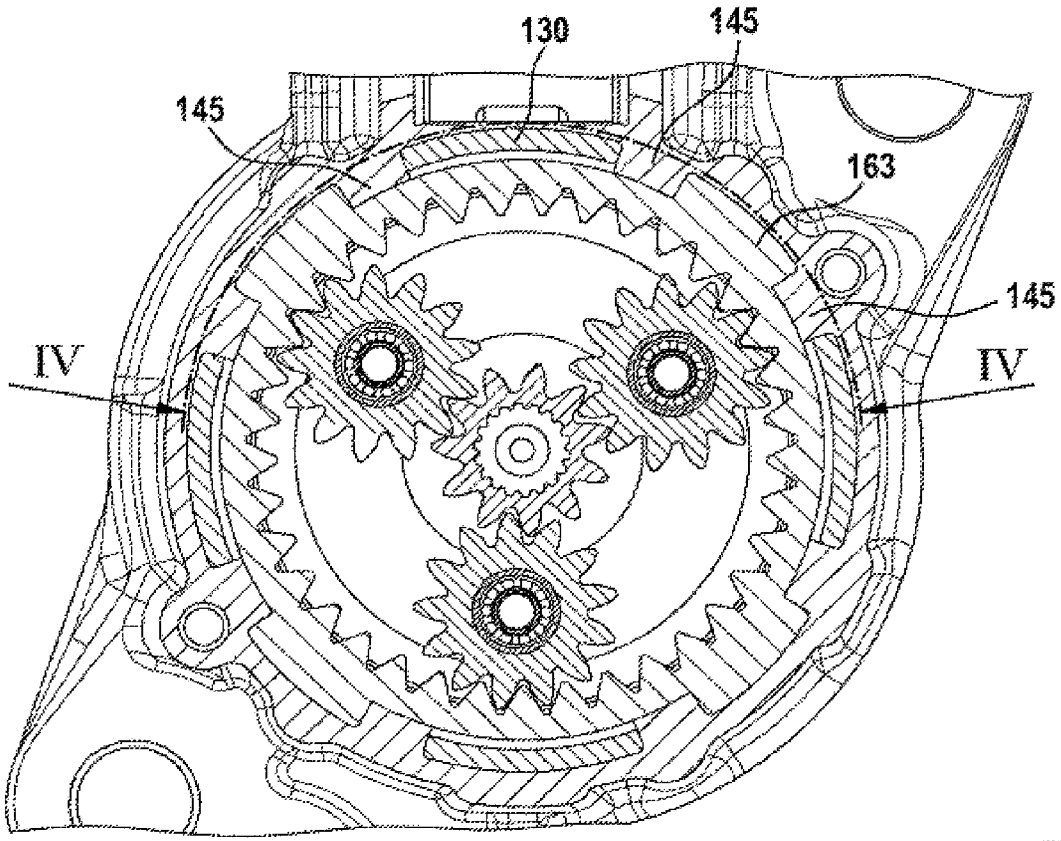
FIG. 3 shows a cross section through the electric machine from FIG. 1.

FIG. 3 illustrates a cross section corresponding to the section line in FIG. 1. Between two webs 145 there is preferably received in each case one peg 163. Between two exemplary webs between which no peg 163 is arranged, there is situated a shield region 130. This illustration does not show that a web 132 is arranged between two webs 145 which receive a peg 163 between them. This means that, as seen in the viewing direction of the viewer of FIG. 3, a web 132 is arranged behind the peg 163.

Figure 4:
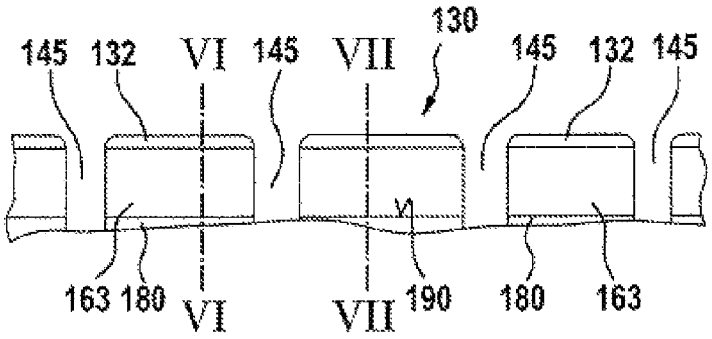
FIG. 4 shows a circumferential section as per the section line IV in FIG. 3.

This is illustrated in FIG. 4. Said figure illustrates, corresponding to the section line IV-IV in FIG. 3, a developed view radially from the outside corresponding to the section line. It can be clearly seen here that the webs 132 and 180 receive the peg 163 between them. Between the two other webs 145, which receive the shield region 130 between them, there is also situated the web 182, which is oriented with a face surface 190 toward the shield region 130.

FIGS. 1 to 6 show an electric machine 10 which is designed as a starter or starting device. The electric machine 10 has a housing part designed as a drive bearing 19. Furthermore, said machine has an electric motor 13 as a drive and has a planetary gearing 153. A drive element 22 is driven, or can be driven, by the electric motor 13. The drive element 22 is for example designed as a drive pinion or cranking pinion. The planetary gearing 153 has, for example, a planet gear 160—three planet gears are preferably provided in the example—which meshes with an internal gear 73. A gear carrier 95, which in this case is for example a planet gear carrier, can be driven by the planet gear 160. The gear carrier 95 is coupled to the drive element 22, such that the drive element 22 can be driven by way of the electric motor 13. The internal gear 73 has an engagement element, and the housing part likewise has an engagement element, wherein the two engagement elements engage into one another in alternating fashion. The engagement element of the internal gear 73 is in this case preferably in the form of a peg 163, and the engagement element of the housing part is preferably in the form of a web 145 or webs 145. The alternating engagement of the engagement elements of the internal gear 73 and of the housing part is shown more clearly for example in FIG. 3 and FIG. 4. Tangential forces and possibly also radial forces are absorbed and transmitted between the internal gear 73 and the housing part. Provision is thus preferably made for the engagement element of the internal gear to be in the form of a peg 163 and for the engagement element of the drive bearing 19 to be in the form of an intermediate space 147 formed as a groove, preferably between two webs 145. Provision is made for the intermediate bearing carrier 98 to have an engagement element and for the housing part to have an engagement element, and for the two engagement elements to engage into one another in alternating fashion.

Provision is furthermore made for an intermediate bearing carrier 98 to be arranged between the separate internal gear 73 and the drive element 22. The intermediate bearing carrier 98 is mounted in the housing part, wherein the intermediate bearing carrier 98 has an engagement element and the housing part has an engagement element. The two engagement elements engage into one another in alternating fashion. In particular, provision is made for the intermediate bearing carrier 98 to have a web 132 as engagement element, and for the housing part to have an intermediate space 147, between two webs 145, as engagement element.

As is illustrated inter alia in FIG. 3, in the case of the electric machine, it is provided in particular that an engagement element of the internal gear, preferably in the form of a peg 163, and an engagement element of the intermediate bearing carrier 98 are arranged at the same circumferential position of the housing part.

It is furthermore provided that, in an intermediate space 147 in the housing part, a peg 163 is delimited in one axial direction by a web 132, as engagement element of the intermediate bearing carrier 98, and in another axial direction by a web 180 of a cover, wherein the cover is preferably formed as a further intermediate bearing carrier 68 and serves for mounting a rotor shaft 84 of the electric motor 13. The engagement element of the intermediate bearing carrier 98 and the engagement element of the internal gear 73 are thus mounted one axially one behind the other in the housing part in relation to an axis of rotation of the gear carrier.

Figure 5:
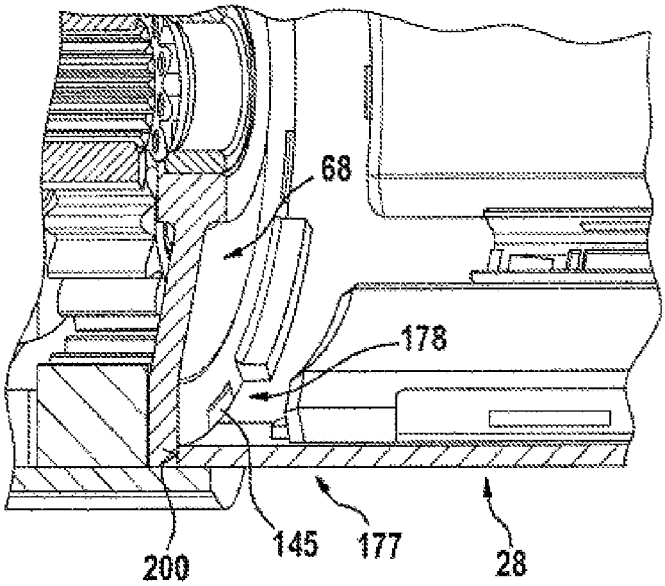
FIG. 5 shows the three-dimensional view of a partial section through a detail of the electric machine from FIG. 1.

FIG. 5 shows a further detail of the first exemplary embodiment. As can be clearly seen, a web 145 projects through an intermediate space 177 of the intermediate bearing carrier 68. Pole housing screws (not illustrated here) which press the brush-side cover 60 against the pole tube 28, and press the latter against the webs 145, thus produce electrically conductive contact between an axially oriented face surface 178 of a web 145 and a face surface, oriented oppositely to said face surface 178, of the pole tube 28. The corresponding face surface of the pole tube 28 is denoted by the reference sign 200.

Figure 6:
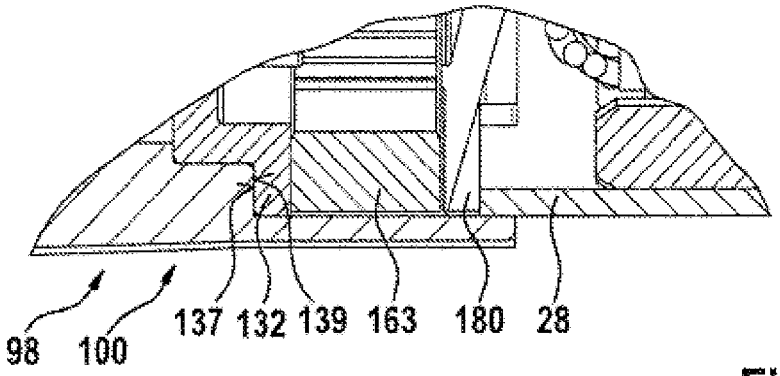
FIG. 6 shows a detail sectional illustration through the planetary gearing as per the section line VI in FIG. 3.

FIG. 6 shows a partial longitudinal section through the intermediate space 147 which is formed, preferably between two webs 145, as a groove. The shoulder 100 of the intermediate bearing carrier 98 with its face surface 139 is followed, axially in succession, by the rear wall 137 of the web 132, the web 132, the peg 163, the web 180 of the intermediate bearing 68 and the pole tube 28.

Figure 7:
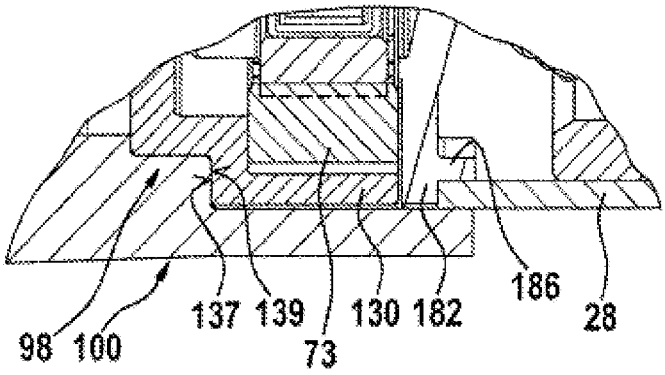
FIG. 7 shows a detail sectional illustration through the planetary gearing as per the section line VII in FIG. 3.

FIG. 7 shows a partial longitudinal section through an intermediate space which is formed, preferably between two webs 145, as a groove. Said intermediate space receives a shield 130. The shoulder 100 of the intermediate bearing carrier 98 with its face surface 139 is followed, axially in succession, by the rear wall 137 of the shield region 130, the web 182 of the intermediate bearing 68, and the pole tube 28.

In said first exemplary embodiment, both the webs 132 and the shield regions 130 are provided as engagement elements which are mounted on the intermediate bearing carrier side and which each absorb forces, for example transverse forces and/or radial forces and/or tangential forces.

Alternatively, said exemplary embodiment could be varied such that only the webs 132 are provided as engagement elements of the intermediate bearing carrier 98 for the purposes of absorbing forces.

Alternatively, said exemplary embodiment could be varied such that only the shield regions 130 are provided as engagement elements of the intermediate bearing carrier 98 for the purposes of absorbing forces.

Figure 8:
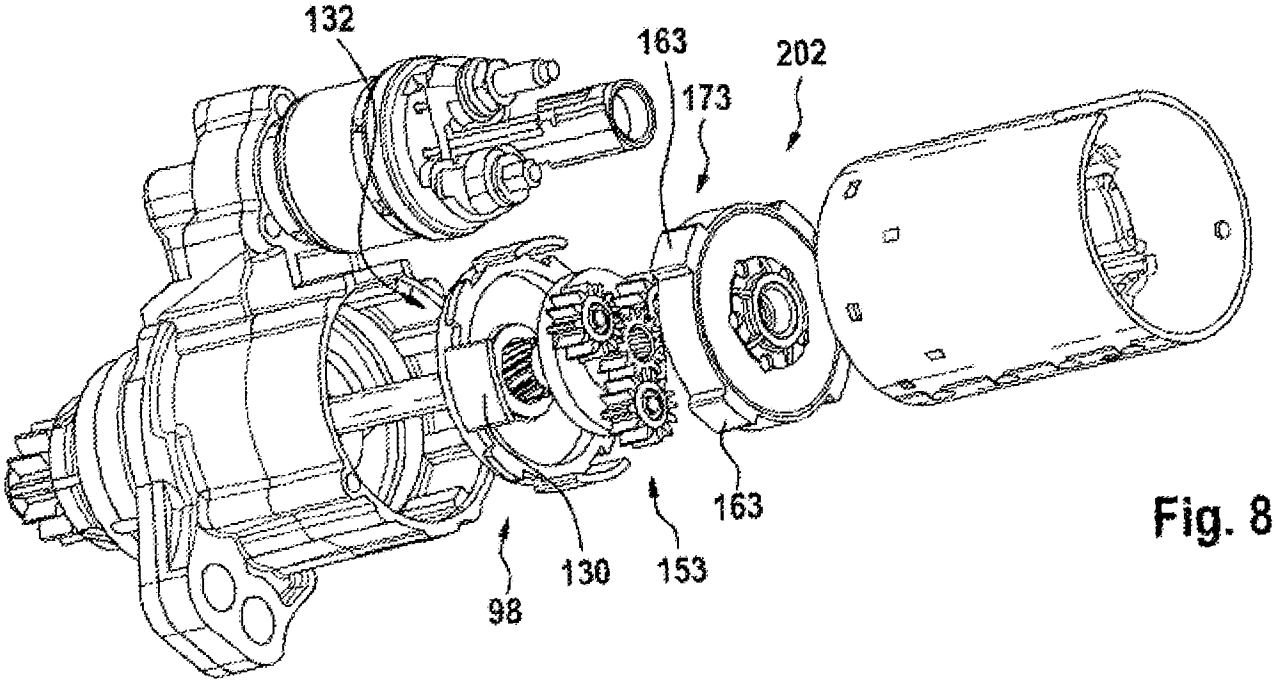
FIG. 8 shows an exploded illustration of a part of a second exemplary embodiment of the starting device.

FIG. 8 illustrates a modification of the first exemplary embodiment. Summarized in abbreviated form, the modification relates primarily to the intermediate bearing carrier between the planetary gearing 153 and the rotor 37 and the internal gear. The internal gear and the intermediate bearing carrier have been combined to form one component and are preferably of integral form (for example unipartite injection molding or assembled unit). By comparison with the first exemplary embodiment, the unit 202 composed of internal gear and intermediate bearing carrier have, by contrast to the two parts from the first exemplary embodiment, been combined to form one part. The engagement element of the intermediate bearing carrier 98 and the engagement element of the internal gear 73—and thus in this case of the unit—alternate in the inner circumferential position of the housing. This is because the shield regions 130 as engagement elements and the pegs 163 as engagement elements follow one another in the circumferential direction.

In the same exemplary embodiment, a web 132 as engagement element of the intermediate bearing carrier 98 and the pegs 163 as engagement element of the internal gear 73—and thus in this case of the unit—are arranged such that an engagement element of the internal gear 73 and an engagement element of the intermediate bearing carrier 98 are arranged at the same circumferential position of the housing part. Thus, an engagement element of the internal gear 73 is adjacent to an engagement element of the intermediate bearing carrier 98 both in a circumferential direction and in an axial direction.

Alternatively, said exemplary embodiment could be varied such that only the webs 132 are provided as engagement elements of the intermediate bearing carrier 98 for the purposes of absorbing forces.

Alternatively, said exemplary embodiment could be varied such that only the shield regions 130 are provided as engagement elements of the intermediate bearing carrier 98 for the purposes of absorbing forces.

What is claimed is:

1. An electric machine comprising a housing part which is in the form of a drive bearing (19), an electric motor (13) as a drive, a planetary gearing (153), an intermediate bearing carrier (98), and a drive element (22), wherein the planetary gearing (153) has a gear carrier (95), an internal gear (73), three planet gears (160) which mesh with the internal gear (73), and a sun gear (161) driven by the electric motor (13), wherein the gear carrier (95) has a central planetary gearing shaft (92) and a flange with three gear pins (156) inserted into the flange, the thee gear pins assigned to the planet gears (160), the gear carrier (95) being coupled to the drive element (22) via the planetary gearing shaft (92) and being configured to be driven by the planet gears (160), wherein the intermediate bearing carrier (98) is a component provided separately from the internal gear (73), and has a central bearing receptacle (102), the central bearing receptacle (102) having a substantially internal cylindrical contour, the cylindrical contour receiving a bearing (105), the bearing (105) supporting the planetary gearing shaft (92), wherein the internal gear (73) has at least one engagement element and the housing part has at least one engagement element, and the at least one engagement element of the internal gear (73) and an engagement element of the housing part engage into one another in alternating fashion, and the intermediate bearing carrier (98) further having at least one engagement element, and the at least one engagement element of the intermediate bearing carrier (98) and the engagement element of the housing part engage into one another in alternating fashion.

2. The electric machine according to claim 1, wherein the at least one engagement element of the internal gear (73) is a peg (163) and the engagement element of the drive bearing (19) is an intermediate space (147).

3. The electric machine according to claim 1, wherein the at least one engagement element of the internal gear (73) is a groove (203) and the engagement element of the drive bearing is a peg (206).

4. The electric machine according to claim 1, wherein the at least one engagement element of the intermediate bearing carrier (98) and the at least one engagement element of the internal gear (73) are mounted one behind the other in the housing part such that the at least one engagement element of the internal gear (73) and the at least one engagement element of the internal bearing carrier (98) engage in the same engagement element of the housing part.

5. The electric machine according to claim 1, wherein at least one engagement element of the internal gear (73) and at least one engagement element of the intermediate bearing carrier (98) alternate in the inner circumferential position of the housing such that the at least one engagement element of the internal gear (73) and the at least one engagement element of the internal bearing carrier (98) engage in two different engagement elements of the housing part.

6. The electric machine according to claim 1, wherein at least one engagement element of the internal gear (73) and at least one engagement element of the intermediate bearing carrier (98) are arranged at the same circumferential position of the housing part.

7. The electric machine according to claim 1, wherein the intermediate bearing carrier (98) is a first intermediate bearing carrier (98), wherein the separate internal gear (73) is arranged between the first intermediate bearing carrier (98) and a second intermediate bearing carrier (68), and the second intermediate bearing carrier (68) is configured for mounting a rotor shaft (84) of the electric motor (13).

8. The electric machine according to claim 1, wherein the intermediate bearing carrier (98) is a first intermediate bearing carrier (98), wherein the internal gear (73) is arranged between the first intermediate bearing carrier (98) and a second intermediate bearing carrier (68), and the second intermediate bearing carrier (68) serves for mounting a rotor shaft (84) of the electric motor (13), wherein the internal gear (73) and the second intermediate bearing carrier (68) are combined to form one component.

9. The electric machine according to claim 1, wherein at least one engagement element of the internal gear (73) is adjacent both in a circumferential direction and in an axial direction to at least one engagement element of the intermediate bearing carrier (98).

10. The electric machine according to claim 1, wherein a web (145) on an inner circumference of the housing part is connected in electrically conductive fashion to a component of the electric motor (13).

11. The electric machine according to claim 1, wherein a web (145) on an inner circumference of the housing part is connected in electrically conductive fashion to a pole tube (18) of the electric motor (13).

12. The electric machine according to claim 1, wherein a web (145) on an inner circumference of the housing part is connected in electrically conductive fashion to a pole tube (18) of the electric motor (13) by abutment at a face side.

13. The electric machine according to claim 1, wherein one of the engagement elements of the internal gear (73) and the housing part is a recess (147, 203) and the other one of the engagement elements of the internal gear (73) and the housing part is a radial projection (163, 206).

14. The electric machine according to claim 13, wherein the recess (147) is between a first web (145) and a second web (145), wherein the first web (145) and the second web (145) are each integrally connected to the housing part and are circumferentially separated from each other, and wherein the radial projection (163) radially projects into the recess (147) from the internal gear (73).

15. The electric machine according to claim 2, wherein the intermediate space (147) is between a first web (145) and a second web (145), wherein the first web (145) and the second web (145) are each integrally connected to the housing part and are circumferentially separated from each other, and wherein the peg (163) radially projects into the intermediate space (147) from the internal gear (73).

16. The electric machine according to claim 2, wherein the first intermediate bearing carrier (98) is arranged between the internal gear (73) and the drive element (22) and is mounted in the housing part, wherein the first intermediate bearing carrier (98) has at least one web (132), wherein a second intermediate bearing carrier (68) is arranged between the internal gear (73) and the electric motor (13) and is mounted at least partially in the housing part, wherein the second intermediate bearing carrier (68) has at least one web (180), and wherein the peg (163), the web (132) of the first intermediate bearing carrier (98), and the web (180) of the second intermediate bearing (68) are seated in the recess (147) and are axially aligned.

17. The electric machine according to claim 16, wherein the web (132) of the first intermediate bearing carrier (98) and the web (180) of the second intermediate bearing carrier (98) are separated in an axial direction by the peg (163) of the internal gear (73).

18. The electric machine according to claim 17, wherein a first web (145) integrally connected to the housing part and a second web (145) integrally connected to the housing part are separated in a circumferential direction such that the intermediate space (147) is between the first web (145) and the second web (145).

19. The electric machine according to claim 1, wherein the at least one engagement element of the intermediate bearing carrier (98) and the at least one engagement element of the internal gear (73) engage in the same engagement element of the housing part.

20. The electric machine according to claim 1, wherein the at least one engagement element of the internal gear (73) and the at least one engagement element of the intermediate bearing carrier (98) engage in different engagement elements of the housing part.

21. An electric machine comprising a housing part which is in the form of a drive bearing (19), an electric motor (13) as a drive, a planetary gearing (153), and a drive element (22), wherein the planetary gearing (153) has at least one planet gear (160) which meshes with an internal gear (73) and a gear carrier (95) that is coupled to the drive element (22) and that is configured to be driven by the planet gear (160), wherein the internal gear (73) has at least one engagement element and the housing part has at least one engagement element, and the at least two engagement elements engage into one another in alternating fashion, and the electric machine further comprising an intermediate bearing carrier (98) has at least one engagement element and the housing part has at least one engagement element, and the at least two engagement elements engage into one another in alternating fashion, wherein the at least one engagement element of the internal gear (73) is a peg (163) and the engagement element of the drive bearing (19) is an intermediate space (147), and wherein the intermediate space (147) is between a first web (145) and a second web (145), wherein the first web (145) and the second web (145) are each integrally connected to the housing part and are circumferentially separated from each other, and wherein the peg (163) radially projects into the intermediate space (147) from the internal gear (73).

22. An electric machine comprising a housing part which is in the form of a drive bearing (19), an electric motor (13) as a drive, a planetary gearing (153), and a drive element (22), wherein the planetary gearing (153) has at least one planet gear (160) which meshes with an internal gear (73) and a gear carrier (95) that is coupled to the drive element (22) and that is configured to be driven by the planet gear (160), wherein the internal gear (73) has at least one engagement element and the housing part has at least one engagement element, and the at least two engagement elements engage into one another in alternating fashion, and the electric machine further comprising an intermediate bearing carrier (98) has at least one engagement element and the housing part has at least one engagement element, and the at least two engagement elements engage into one another in alternating fashion, wherein the at least one engagement element of the internal gear (73) is a peg (163) and the engagement element of the drive bearing (19) is an intermediate space (147), wherein the first intermediate bearing carrier (98) is arranged between the internal gear (73) and the drive element (22) and is mounted in the housing part, wherein the first intermediate bearing carrier (98) has at least one web (132), wherein a second intermediate bearing carrier (68) is arranged between the internal gear (73) and the electric motor (13) and is mounted at least partially in the housing part, wherein the second intermediate bearing carrier (68) has at least one web (180), and wherein the peg (163), the web (132) of the first intermediate bearing carrier (98), and the web (180) of the second intermediate bearing (68) are seated in the recess (147) and are axially aligned.

23. The electric machine according to claim 22, wherein the web (132) of the first intermediate bearing carrier (98) and the web (180) of the second intermediate bearing carrier (98) are separated in an axial direction by the peg (163) of the internal gear (73).

24. The electric machine according to claim 23, wherein a first web (145) integrally connected to the housing part and a second web (145) integrally connected to the housing part are separated in a circumferential direction such that the intermediate space (147) is between the first web (145) and the second web (145).

* * * * *